US005428339A

United States Patent [19]

Das

[11] Patent Number: 5,428,339

[45] Date of Patent: Jun. 27, 1995

[54] TRIMMABLE RESISTORS WITH REDUCIBLE RESISTANCE AND METHOD OF MANUFACTURE

[75] Inventor: Stephen D. Das, Lake Jackson, Tex.

[73] Assignee: Intermedics, Inc., Angleton, Tex.

[21] Appl. No.: 146,579

[22] Filed: Nov. 1, 1993

[51] Int. Cl.[6] ..... H01C 10/10

[52] U.S. Cl. ..... 338/195; 338/295; 338/306; 338/309; 29/620; 29/621

[58] Field of Search ..... 338/195, 295, 306–314; 29/610.1, 620, 621

[56] References Cited

U.S. PATENT DOCUMENTS

| | | | |
|---|---|---|---|
| 2,758,256 | 8/1956 | Eisler | 338/195 X |
| 2,878,357 | 3/1959 | Thomson et al. | 338/195 X |
| 4,017,821 | 4/1977 | Schmidt | 338/95 |
| 4,216,444 | 8/1980 | Vergnolle et al. | 338/195 X |
| 4,859,980 | 8/1989 | Hammond | 338/308 |

OTHER PUBLICATIONS

"Small Size, Wide Trim Precision Thick Film Resistor", Greenstein, ISHM '93 Proceedings, pp. 700–707, Nov. 9–11, 1993.

Giesecke et al. "Stability of Reducing Resistance of Thick Film Resistors by Lasar Treatment", ISHM '92 Proceedings, 1992.

*Primary Examiner*—Marvin M. Lateef

*Attorney, Agent, or Firm*—John R. Merkling

[57] ABSTRACT

A trimmable resistor which is prepared with additional electrical contacts between the resistor and the substrate. These contacts are usually not connected electrically to the electronic circuit. Moreover, they do not extend across the entire width of the resistor. If the resistor is over trimmed, its resistance can be reduced by wire bonding a selected one of the additional electrical contacts to an end contact of the resistor. Multiple contacts may be placed along the substrate, both on the side of the resistor where trimming is to take place and on an opposite side.

18 Claims, 1 Drawing Sheet

TRIMMABLE RESISTORS WITH REDUCIBLE RESISTANCE AND METHOD OF MANUFACTURE

FIELD OF MY INVENTION

My invention relates to trimmable resistors, and in particular to thick or thin film resistors whose resistance can be reduced after manufacture.

BACKGROUND OF THE INVENTION

Thick or thin film resistors (TFRs) are frequently used in hybrid and other electronic circuits. TFRs are constructed by applying a resistive ink over a substrate having gold electrical contacts and firing the resulting structure. Due to variations in the printing and firing process, TFRs are usually built with a resistance lower than the required value for the circuit. To bring the TFR into tolerance, the resistance is adjusted, usually by laser trimming. Areas of the resistor are vaporized by a laser beam or by other know methods until the resistance value of the resistor comes within specification.

It is possible, however, to over-trim the resistor, resulting in a resistance which is higher than the desired range of values specified for the design. It is desirable, therefore, to have a technique for reducing the resistance again so that further trimming may be attempted, again approaching the specified resistance. In the past, various techniques have been proposed to achieve resistance reduction. These methods have included electric discharge trimming and laser beam irradiation. There remains a need for a simple and effective method of reducing thick film resistance to permit retrimming during manufacture of electronic circuits.

SUMMARY OF MY INVENTION

I have invented a trimmable resistor which is prepared with additional electrical contacts between the resistor and the substrate. These contacts are usually not connected electrically to the electronic circuit. Moreover, they do not extend across the entire width of the resistor. If the resistor is over trimmed, its resistance can be reduced by wire bonding a selected one of the additional electrical contacts to an end contact of the resistor. Multiple contacts may be placed along the substrate, both on the side of the resistor where trimming is to take place and on an opposite side. Different effects can be expected by connecting electrical contacts or tabs on different sides of the resistor.

It is an object of my invention, therefore, to provide a trimmable resistor whose resistance can be reduced during manufacture in a simple and effective manner. It is a further object to my invention to provide a trimmable resistor with reducible resistance which maintains stable operating parameters.

These and other objects and features of my invention will be apparent from the following detailed description of my preferred embodiment, taken with respect to the accompanying drawings.

DETAILED DESCRIPTION OF MY PREFERRED EMBODIMENT

Figure 1:
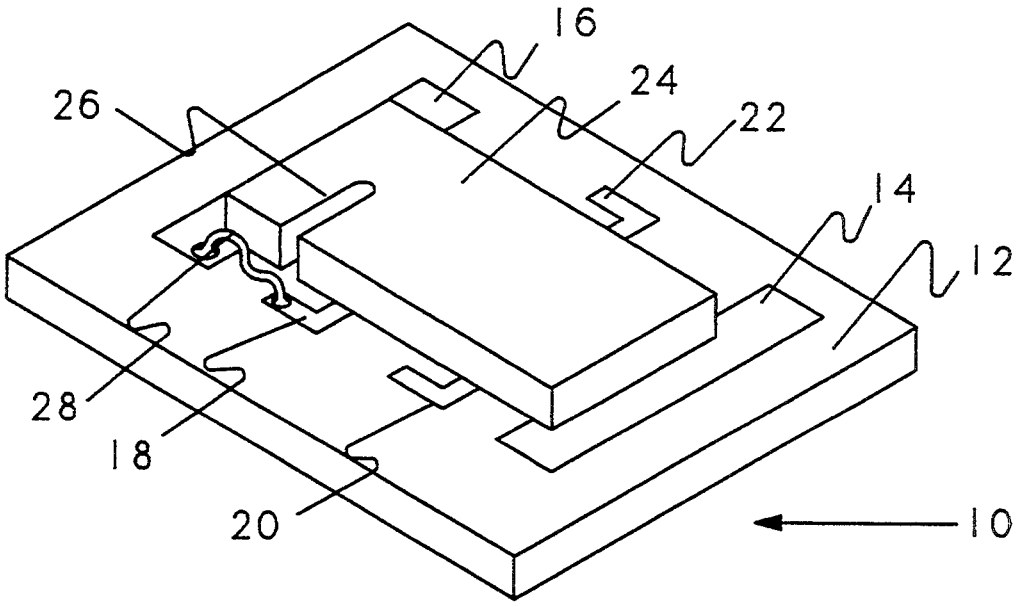
FIG. 1 is a perspective view of a trimmable resistor according to my invention.
Figure 2:
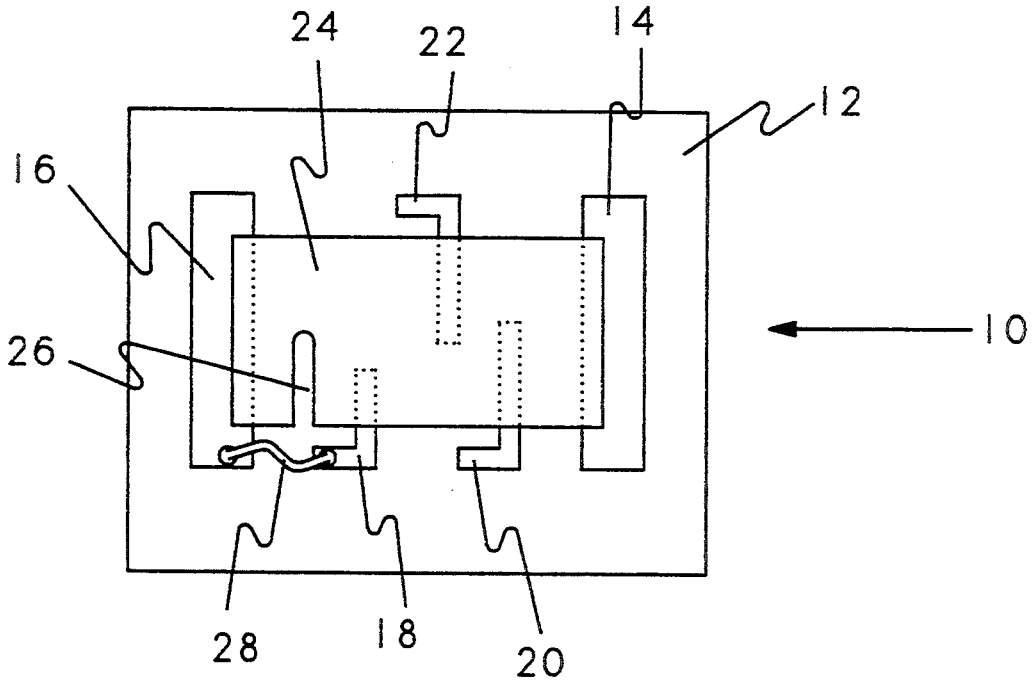
FIG. 2 is top plan view of the resistor of FIG. 1.

FIG. 1 shows a perspective view of trimmable resistor 10 according to my invention. The resistor is mounted on a nonconductive substrate 12 which also supports other electric components of an electronic circuit. These components are not shown herein. On the substrate 12, there is stenciled a first end connection 14 and a second end connection 16. I prefer to use gold for these connections, but other materials, such as copper or tungsten can also be used. The first and second end connections 14, 16 will be wire bonded to other parts of the electronic circuit in a conventional manner, or may extend to those other circuit components as part of the designed circuit layout.

In addition to the end connectors 14, 16, I have provided additional conductive tabs 18, 20 and 22. These conductive tabs 18–22 are preferably gold (although, as mentioned, other materials are also suitable), and stenciled on the substrate at the same time the end connectors are created. Multiple tabs can be provided on one or both sides of the resistor. As shown in the figure, a resistive ink or film 24 is then applied over the tabs, connecting the first and second end connectors. The resistive film 24 is placed such that the tabs 18 through 22 will not extend completely across the resistive film 24. After the film has been deposited on substrate, it is fired in a conventional manner. Thereafter, laser trimming or another known method is used to vaporize or cut a notch 26 into the resistor film 24 in a known manner. The notch 26 essentially reduces the effective width of the resistive film 24 and increases its resistance to electrical flow.

If the resistor is over trimmed, however, and its resistance increases beyond permissible specifications, the resistance of the film 24 can be reduced by connecting a selected one of the tabs 18–22 to the cathode connector 16 with a wire bond 28. Connecting a tab to the cathode connector 16 creates, in effect, an electrical shadow which eliminates, in whole or in part, the effect of the notch 26. If the tabs are on the same side of the resistor as the notch 26, the effect will be to reduce or eliminate the effective height of the notch. Thus, a tab, such as tab 18, which is shorter than the notch 26 will not completely reduce the effect of the notch. On the other hand, a tab such as tab 20 which extends under the resistor for a distance greater than or equal to the length of the notch 26 will substantially eliminate the increase in resistance due to the notch 26.

Tabs can also be used on the side of the resistive film 24 away from the notch 26, such as tab 22. Such tabs, if connected to the cathode connector 16 also reduce the resistance of the resistor, but to a lesser extent than same side tabs, such as tabs 18 and 20. Thus, by selecting short or long tabs on the same side or the opposite side of the resistor from the notch 26, the resistance of the thick film can be lowered in a predictable fashion. Although the exact amount of reduction in resistance would not be known a priori, the tabs could be temporarily connected to observe the effect on the resistance of a particular resistor before making a permanent wire bond. Alternatively, tab and end connector could be connected by a wire bond and the wire bond again removed should that be necessary. This would result in again raising the resistance of the resistor.

My invention may be embodied in other specific designs without departing from the spirit and teachings thereof and the, foregoing description should be viewed in all respects as illustrative and not restrictive. The scope of my invention is to be defined by the appended claims.

I claim as my invention:

1. A resistor comprising a substrate for supporting the resistor, a first end connector on said substrate for providing an electrical connection between the resistor and an electric circuit, a second end connector, spaced away from said first end connector on said substrate for providing a second connection between said resistor and said electric circuit, at least one electrically conductive tab on said substrate and between said end connectors, a resistive layer connecting said first and second end connectors and partially covering said conductive tab, said resistive layer having first and second sides spaced such that said conductive tab extends outwardly from said first side and has a length which does not extend from said first side to said second side, and means for selectively connecting said tab to a selected one of said end connectors.

2. The resistor according to claim 1 further comprising a plurality of conductive tabs.

3. The resistor according to claim 2 wherein the length of at least one conductive tab is shorter than the length of another of said tabs.

4. The resistor according to claim 2 further comprising at least one conductive tab extending outwardly from said second side and not extending from said second side to said first side.

5. The resistor according to claim 4 wherein the length of at least one conductive tab is shorter than the length of another of said tabs.

6. The resistor according to claim 5 wherein said tabs are gold.

7. A method for making a trimmable resistor comprising the steps of placing a first end connector on a substrate for providing an electrical connection between the resistor and an electric circuit, placing a second end connector, spaced away from said first end connector on said substrate for providing a second connection between said resistor and said electric circuit, placing at least one electrically conductive tab on said substrate and between said end connectors said tab having a length extending between said end connectors, providing a resistive layer connecting said first and second end connectors and partially covering said conductive tab, said resistive layer having first and second sides spaced such that said conductive tab extends outwardly from said first side and the length of said tab does not extend from said first side to said second side.

8. The method according to claim 7 wherein the step of placing at least one tab comprises placing a plurality of conductive tabs.

9. The method according to claim 7 wherein at another least one conductive tab has a length different from another of said tabs.

10. The method according to claim 8 further comprising placing at least one conductive tab extending outwardly from said second side and not extending from said second side to said first side.

11. The method according to claim 10 wherein at another least one conductive tab has a length different from another of said tabs.

12. The method according to claim 11 wherein said tabs are gold.

13. A method for making a trimmable resistor comprising the steps of placing a first end connector on a substrate for providing an electrical connection between the resistor and an electric circuit, placing a second end connector, spaced away from said first end connector on said substrate for providing a second connection between said resistor and said electric circuit, placing at least one electrically conductive tab on said substrate and between said end connectors said tabs having a length extending between said end conductors, providing a resistive layer connecting said first and second end connectors and partially covering said conductive tab, said resistive layer having first and second sides spaced such that said conductive tab extends outwardly from said first side and the length of said tab does not extend from said first side to said second side, cutting away a portion of said resistive layer to increase the electrical resistance of said resistive layer to a preselected value, electrically connecting a selected conductive tab to a selected end connector to reduce the electrical resistance of said resistive layer if said resistance exceeds said preselected value; and re-trimming a second portion of said resistive layer to increase the electrical resistance towards said preselected value.

14. The method according to claim 13 wherein the step of placing at least one tab comprises placing a plurality of conductive tabs.

15. The method according to claim 7 wherein at least one conductive tab has a length different from another of said tabs.

16. The method according to claim 14 further comprising placing at least one conductive tab extending outwardly from said second side and not extending from said second side to said first side.

17. The method according to claim 16 wherein at least one conductive tab has a length different from another of said tabs.

18. The method according to claim 17 wherein said tabs are gold.

* * * * *